United States Patent [19]

Bahnemann et al.

[11] Patent Number: 4,729,065

[45] Date of Patent: Mar. 1, 1988

[54] PHOTOGRAPHY LIGHT

[75] Inventors: Volker W. Bahnemann, Greenwich, Conn.; Stanislaw Loth, Nanuet, N.Y.

[73] Assignee: Arriflex Corporation, Blauvelt, N.Y.

[21] Appl. No.: 42,307

[22] Filed: Apr. 24, 1987

[51] Int. Cl.[4] ..... G03B 15/02; F21V 7/00; F21V 19/02

[52] U.S. Cl. ..... 362/18; 362/285; 362/232; 362/247; 362/304

[58] Field of Search ..... 362/285, 286, 289, 18, 362/232, 304, 305, 247

[56] References Cited

U.S. PATENT DOCUMENTS

| | | | |
|---|---|---|---|
| 1,543,230 | 6/1925 | O'Lear | 362/285 |
| 1,880,399 | 10/1932 | Benjamin | 362/304 |
| 4,519,020 | 5/1985 | Little | 362/305 |
| 4,602,321 | 7/1986 | Bornhorst | 362/285 |

*Primary Examiner*—Albert W. Davis, Jr.
*Attorney, Agent, or Firm*—Toren, McGeady & Associates

[57] ABSTRACT

A photography light for providing fill illumination includes a first reflector having planar sides and an opening in a rear portion thereof, a second reflector lying within the first reflector and overlying the opening therein. The second reflector forming light compensating channels with the sides of the first reflector and includes at least one aperture in a rear surface thereof through which lamps may be variably positioned. The light compensating channels allow a portion of the light blocked by the backs of the reflectors when the lamps are in a retracted position, to pass to the front portion of the reflectors to be reflected into the photographing field thereby smoothing the illumination therein.

10 Claims, 8 Drawing Figures

PHOTOGRAPHY LIGHT

BACKGROUND OF THE INVENTION

1. Field of the Invention

The invention relates to photography lights, and particularly to photography lights for providing "fill" illumination.

In the filming process with a film or video camera, there is need for adjustable lighting equipment which allows the photographer to continuously change the light value and intensity without changing the beam angle or the color temperature.

2. Description of Related Art

Most conventional lights accomplish a change in intensity by either varying the position of the bulb relative to the reflector or by varying the voltage to the bulb, which, in turn, changes the color temperature of the light.

FIGS. 1 and 2 show arrangements of light fixtures which produce, respectively, a wide-angle and a spot light. While these arrangements change the intensity of light falling on an object in the photographing field, as compared to the spot light, the wide-angle light sheds a significant amount of light on the surrounding area thereby changing the balance of light in this surrounding area.

There are, however, lights which accomplish this change in intensity without changing the beam angle or the color temperature. These lights accomplish this change in intensity by changing the reflectance of the reflector of the lighting arrangement from white to black, thus changing the amount of light emitted from the arrangement.

U.S. Pat. No. 4,200,902 to Intractor discloses a photography light which includes alternate black and white strips arranged behind a light source for controlling the amount of light reflected into the photographing field. The ratio of the area of the black strips to the white strips is adjustable by the photographer to effectively vary the intensity of the light into the photographing field.

An arrangement known in the prior art includes a plurality of rods arranged behind a light source as in the patent to Intractor. As shown in FIG. 3, the rods are formed such that half of the surface, around the circumference thereof, is a white, reflective color, while the other half of the surface is a black absorptive color. By controlling the rotational position of the rods in synchronism, the photographer is able to control the intensity of the light into the photographing field.

Another arrangement of the prior art light fixtures, as shown in FIG. 4, positions controllable shutters in front of the light fixture to control the amount of light emitted therefrom.

While the above light fixtures effectively control the intensity of the light into the photographing field, each of these fixtures produces an irregularity in the intensity of the light which may show up in the photographing field as an alternating array of light and dark stripes. In other words, neither of these lights produces uniform illumination.

SUMMARY OF THE INVENTION

An object of the present invention is to provide a photography light which is adjustable in intensity without changing the color temperature thereof.

Another object of the present invention is to provide an adjustable photography light which exhibits uniform light intensity in the photographing field.

The above objects are achieved in a photography light comprising a system of reflectors including at least a first reflector of an appropriate geometric shape having an opening at a rear portion thereof to serve as a light compensating channel, and a second reflector lying within said first reflector and spaced from the opening in said first reflector, said second reflector having at least one opening at a rear portion thereof for respectively receiving an elongated lamp, said lamp being retractable within said opening in said second reflector whereby in a fully inserted position, light from said lamp reflects from inner surfaces of said first and second reflectors to illuminate the photographing field, while in progressively retracted positions, lesser portions of said light is reflected from said inner surfaces while greater portions of said light is reflected from a back surface of said second reflector into said light compensating channel and finally to said inner surface of said first reflector, thereby providing a progressively lower intensity of light to the photographing field while maintaining a uniform illumination thereof.

DESCRIPTION OF THE DRAWINGS

With the above and additional objects and advantages in mind as will hereinafter appear, the invention will be described with reference to the accompanying drawings, in which.

DESCRIPTION OF THE PREFERRED EMBODIMENT

Figure 2:
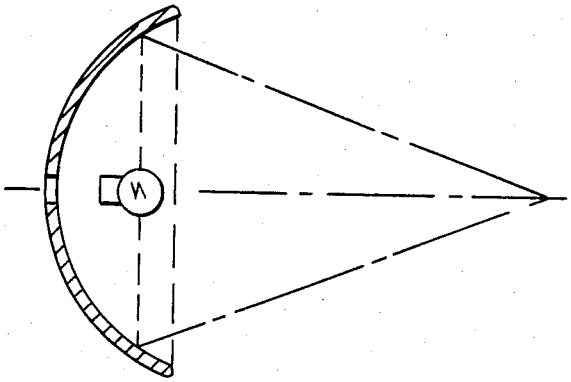
FIG. 2 PRIOR ART
FIG. 2 is an illustration of a prior art light fixture with a lighting element arranged to produce a spot beam.
Figure 1:
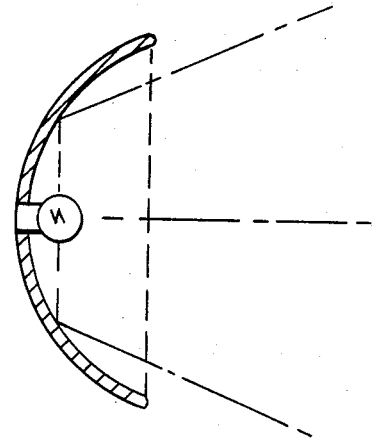
FIG. 1 PRIOR ART
FIG. 1 is an illustration of a prior art light fixture with a lighting element to produce a wide-angle beam.
Figure 3:
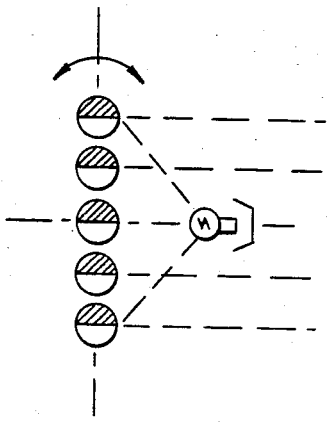
FIG. 3 PRIOR ART
FIG. 3 is an illustration of a prior art light fixture having rotatable alternately colored rods positioned behind a lighting element.
Figure 4:
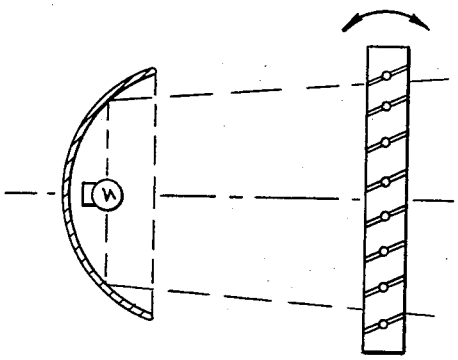
FIG. 4 PRIOR ART
FIG. 4 is an illustration of a prior art light fixture having adjustable light shutters positioned at a front light projecting portion thereof.
Figure 5:
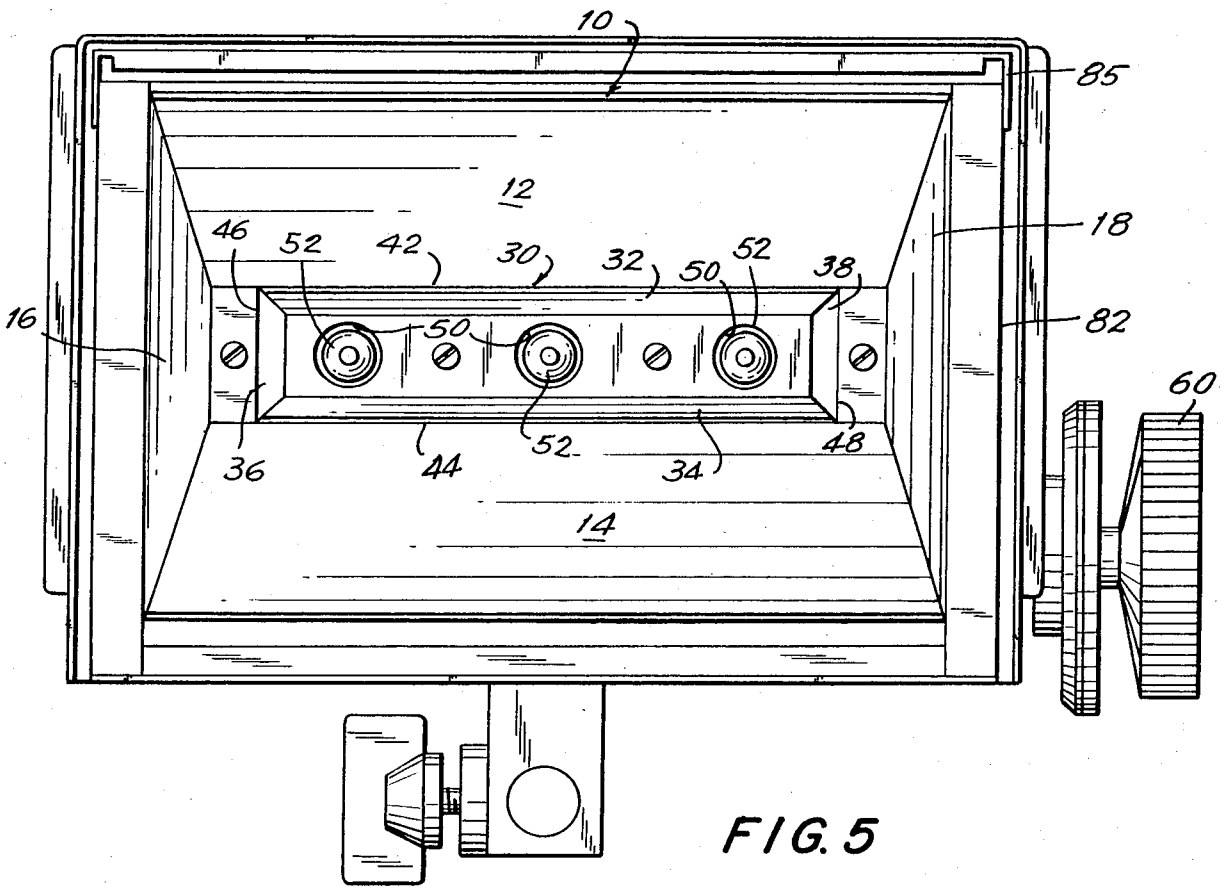
FIG. 5 is a front plan view of a light arrangement of the subject invention.

FIG. 5 shows an arrangement of a photography light in accordance with the subject invention. The photography light includes a main reflector 10 having planar upper and lower surfaces 12 and 14 and planar sides 16 and 18. The surfaces 12 and 14 and the sides 16 and 18 are so arranged as to form an opening 20 in the rear of the main reflector 10.

The photography light also includes a secondary reflector 30 also having planar upper and lower surfaces 32 and 34, planar sides 36 and 38, and a rear surface 40. The secondary reflector 30 is positioned within the main reflector 10 and spaced from the rear opening 20 therein forming light compensating channels 42 and 44 between the surface 12 and 32 and between the surfaces 14 and 34, respectively (see FIG. 6C). Light compensating channels 46 and 48 are also formed between the sides 16 and 36 and between the sides 18 and 38, respectively.

Figure 6A:
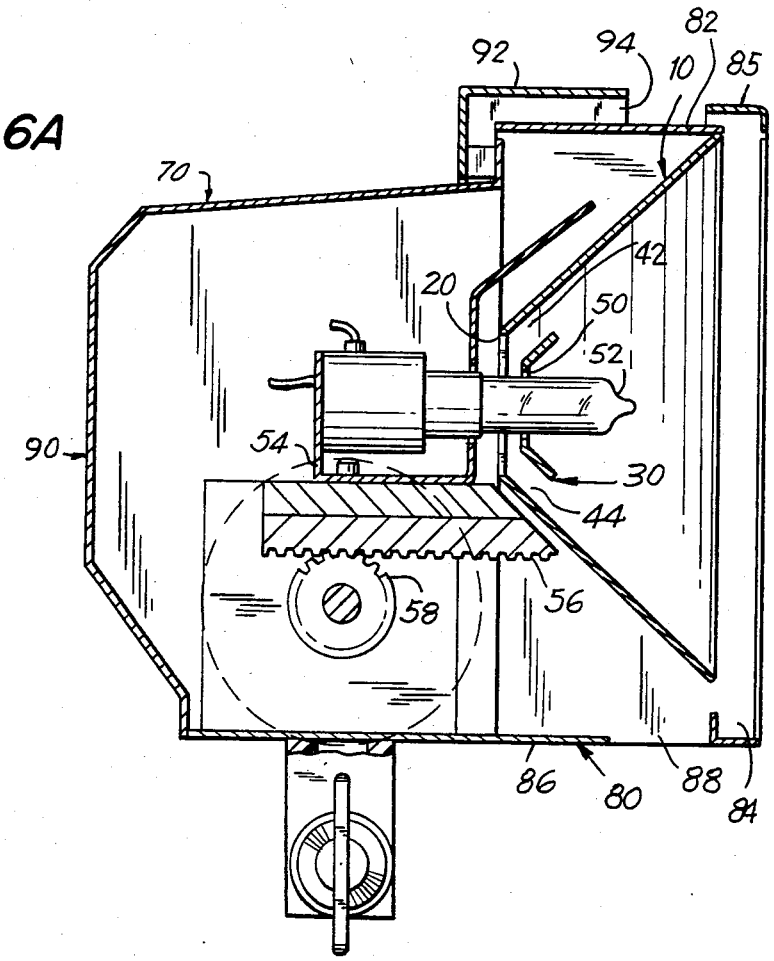
FIGS. 6A and 6B are side cross-sectional views of the light arrangement of the subject invention showing the lighting element thereof in a fully inserted and fully retracted position thereof, respectively.
Figure 6B:
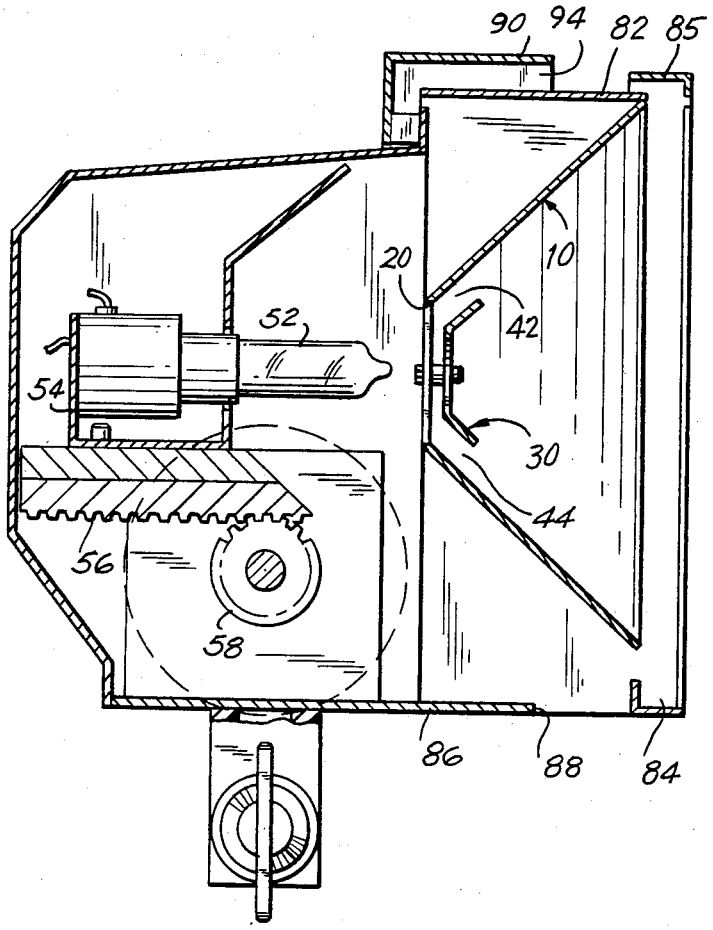
Figure 6C:
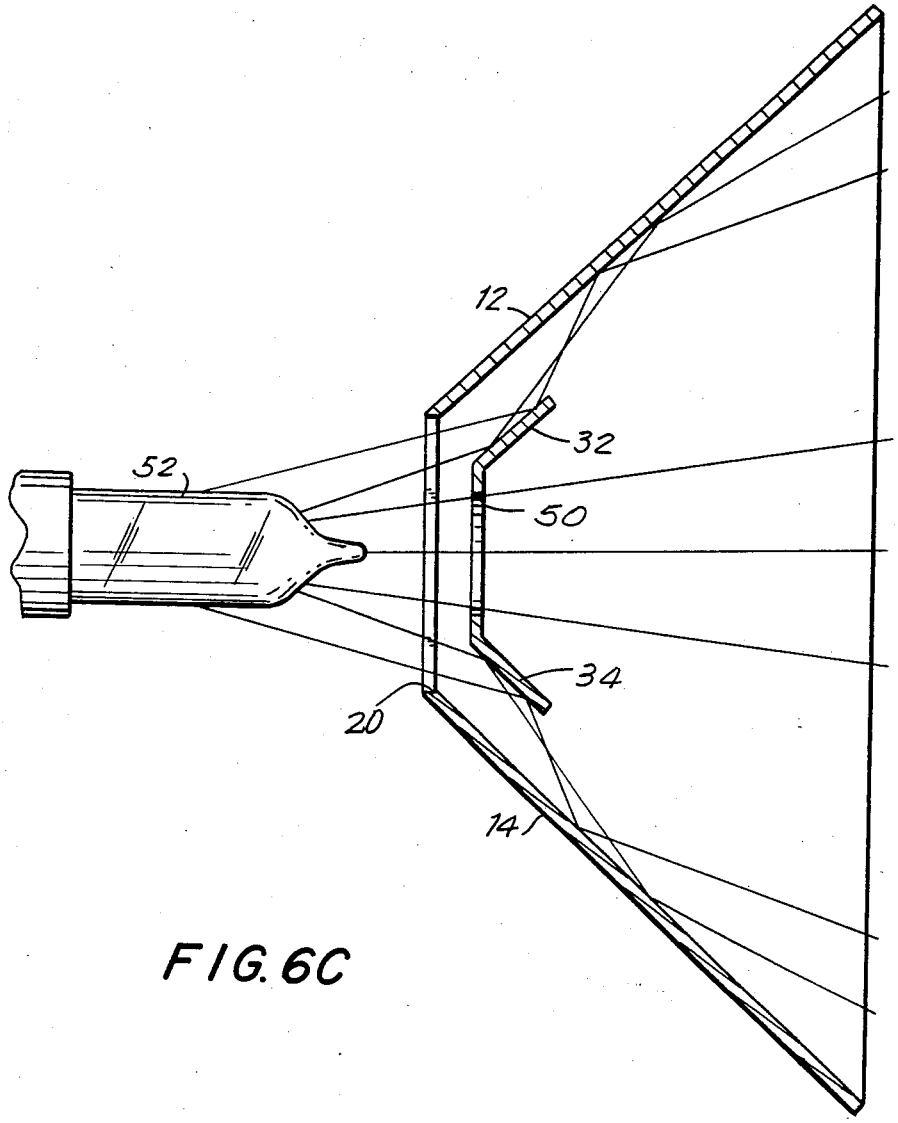
FIG. 6C is an expanded view of a portion of FIG. 6B showing the light compensating channels of the invention.

The rear surface 40 of the secondary reflector 30 has apertures 50 formed colinearly therein through which lamps 52 are retractably arranged. The lamps 52 are of a long filament type or elongated gas discharge type. The lamps 52 are arranged on a fixture 54 which is movable along the axis of the apertures 50 in the rear surface 40 of the secondary reflector 30. A rack 56 is mounted to the fixture 54 along the axis of the apertures 50 and is engaged by a pinion 58 having a calibrated adjustment knob 60, as shown in FIGS. 6A and 6B.

The above arrangement of the first and second reflectors 10 and 30, respectively, and the fixture 54 are arranged inside of a housing 70 having a frame 80 and a cover 90 therefor. The frame 80 includes a front portion 82 extending around the periphery of the first reflector 10. The front portion 82 includes channels 84 positioned on opposite sides of the front portion 82. Various filters (not shown) may be inserted into the channels 84 covering the front opening of the first reflector 10 thereby allowing the photographer to create a desired lighting effect. A pivotable door 85 is arranged at the top of the front portion 82 for covering the channels 84 and an edge of any filter inserted in the channels 84. The frame 80 also includes a bottom portion 86 in which ventilation slots 88 are formed.

The cover 90 also has a front portion 92 for substantially overlying the front portion 82 of the frame 80. In so doing, a ventilation channel 94 is formed therebetween which is arranged so that light may not pass therethrough.

Heat dissipating fins 98 are positioned on the cover 90 and the frame 80 for dissipating heat generated by the lamps 52.

In operation, the lamps 52, when fully inserted into the apertures 50 formed in the rear surface 40 of the secondary reflector 30, as shown in FIG. 6A, light therefrom radiates directly into the photographing field and is reflected by the surfaces 12, 14, 32 and 34, the sides 16, 18, 36 and 38, and the rear surface 40 into the photographing field. When the lamps 52 are retracted, as shown in FIG. 6B, while a portion of the light therefrom pass through the apertures 50, most of the light is blocked by the backs of the reflectors 10 and 30. However, a portion of the light blocked by the reflectors 10 and 30 passes through the light compensating channels 42, 44, 46 and 48 and is spread into the photographing field by the main reflector 10. To this end, the backs of the surfaces 32 and 32 and of the sides 36 and 38 of the secondary reflector 30 are made reflective to reflect a portion of the light blocked by the reflectors 10 and 30 from the lamps 52 into the light compensating channels 42–48. It should be apparent that in intermediate positions of the lamps 52, varying portions of the light therefrom directly illuminate the photographing field while varying portions thereof pass through the light compensating channels 42–48. The purpose of the light compensating channels 42–48 is to smooth the distribution of light into the photographing field thereby providing even illumination.

While the above embodiment of the invention shows three lamps 52, the invention contemplates the use of any number of lamps, including one, arranged in any desirable configuration.

Numerous alterations of the structure herein disclosed will suggest themselves to those skilled in the art. However, it is to be understood that the present embodiment is for purposes of illustration only and not to be construed as a limitation of the invention. All such modifications which do not depart from the spirit of the invention are intended to be included within the scope of the appended claims.

What is claimed is:

1. A photography light comprising:

(a) a main reflector having an upper surface, a lower surface, and two side surfaces, said surfaces being made reflective on an inner portion of said main reflector, said main reflector also being formed with an opening in a rear portion thereof;

(b) a secondary reflector also having an upper surface, a lower surface, and two side surfaces, said secondary reflector further having a rear surface having aperture means formed therein, said surfaces being made reflective on an inner portion of said secondary reflector, said secondary reflector being positioned within and spaced from said opening in said main reflector such that said aperture means in said secondary reflector overlies said opening and the surfaces of said secondary reflector form light compensating channels with the respective surfaces of said main reflector;

(c) illuminating means positionable within said aperture means for illuminating a photographing field, said illuminating means being elongated along an axis of said aperture means; and (d) means for positioning said illuminating means along said axis of said aperture means in a first position, in which said illuminating means is fully inserted in said aperture means and all the illumination therefrom is available for illuminating said photographing field, and in a second position, in which said illuminating means is fully retracted from said aperture means and only a portion of the illumination therefrom passes through said aperture means and said light compensating channels, a remaining portion of said illumination being blocked by a back surface of said main and secondary reflectors.

2. A photography light as claimed in claim 1, wherein said positioning means also positions said illuminating means in variable intermediate positions of said illuminating means between said first position and said second position, varying portions of the illumination radiated from said illuminating means passing through said aperture means and said light compensating channels as said illuminating means is positioned in said intermediate positions.

3. A photography light as claimed in claim 1, wherein said surfaces of said main reflector are planar.

4. A photography light as claimed in claim 3, wherein said surfaces of said secondary reflector are planar.

5. A photography light as claimed in claim 1, wherein said illuminating means comprises a plurality of lamps elongated along the axis of said aperture means.

6. A photography light as claimed in claim 5, wherein said plurality of lamps are three lamps.

7. A photography light as claimed in claim 5, wherein said plurality of lamps are of a long filament type.

8. A photography light as claimed in claim 5, wherein said plurality of lamps are gas discharge type.

9. A photography light as claimed in claim 2, wherein said positioning means includes:

(1) a fixture to which said illuminating means is mounted;

(2) a rack mounted to a bottom surface of said fixture along the axis of said aperture means;

(3) a pinion for engaging said rack; and (4) a calibrated knob for rotating said pinion, whereby when said knob is rotated, said pinion also rotates causing said rack to variably position said fixture and said illuminating means along the axis of said aperture means.

10. A photography light as claimed in claim 1, wherein the surfaces of the secondary reflector are reflective on the back portion of the secondary reflector at said light compensating channels.

* * * * *